US006431773B1

(12) United States Patent
Plumley et al.

(10) Patent No.: US 6,431,773 B1
(45) **Date of Patent: *Aug. 13, 2002**

(54) METHOD AND APPARATUS FOR PRINTING ON A CONTINUOUSLY MOVING SHEET OF WORK MATERIAL

(75) Inventors: A. Bruce Plumley, Middletown; Darryl Colburn Stein, Andover, both of CT (US)

(73) Assignee: Gerber Technology, Inc., Tolland, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/516,541

(22) Filed: Mar. 1, 2000

Related U.S. Application Data

(63) Continuation of application No. 09/166,314, filed on Oct. 5, 1998, now Pat. No. 6,056,454.

(51) Int. Cl.[7] ..... B41J 11/36

(52) U.S. Cl. ..... 400/120.16; 400/320.1; 400/323; 347/37; 347/218

(58) Field of Search ..... 400/120.16, 120.17, 400/578, 283, 319, 320, 320.1, 323; 101/93.04, 93.05, 93.47; 347/101, 104, 37, 215, 218

(56) References Cited

U.S. PATENT DOCUMENTS

| | | | | |
|---|---|---|---|---|
| 3,742,846 A | | 7/1973 | Knappe | 101/93.05 |
| 4,069,485 A | | 1/1978 | Martin | 347/12 |
| 4,167,014 A | | 9/1979 | Darling et al. | 347/37 |
| 4,227,455 A | * | 10/1980 | Pennebaker | 101/93.05 |
| 4,273,040 A | | 6/1981 | Sebrosky et al. | 101/93.04 |
| 4,293,863 A | * | 10/1981 | Davis et al. | 400/126 |
| 4,693,043 A | | 9/1987 | Knapp | 52/211 |
| 4,759,646 A | * | 7/1988 | Piatt | 400/88 |
| 5,043,748 A | | 8/1991 | Katayama et al. | 347/14 |
| 5,228,789 A | | 7/1993 | Starr et al. | 400/224 |
| 5,322,377 A | * | 6/1994 | Asai | 400/55 |
| 5,428,375 A | | 6/1995 | Simon et al. | 347/12 |
| 5,444,469 A | | 8/1995 | Cowger | 347/14 |
| 5,446,358 A | | 8/1995 | Nakata | 318/696 |
| 5,469,197 A | | 11/1995 | Hiramatsu | 347/16 |
| 5,896,154 A | * | 4/1999 | Mitani et al. | 347/102 |

FOREIGN PATENT DOCUMENTS

| | | |
|---|---|---|
| DE | 34 46 226 | 6/1986 |
| DE | 41 20 293 | 2/1992 |
| EP | 333609 | 9/1989 |
| EP | 0 589 669 A1 | 9/1993 |
| EP | 0 829 368 A2 | 9/1997 |
| EP | 0 881 820 A2 | 12/1998 |
| JP | 61-141567 | 6/1986 |
| JP | 2-292047 | 12/1990 |
| JP | 3-96374 | 4/1991 |
| JP | Hei 4-113870 | 4/1992 |
| JP | 4-251769 | 9/1992 |
| JP | 4-320866 | 11/1992 |
| JP | 6-71964 | 3/1994 |
| JP | 6-198867 | 7/1994 |

* cited by examiner

*Primary Examiner*—Daniel J. Colilla
(74) *Attorney, Agent, or Firm*—McCormick, Paulding & Huber LLP

(57) ABSTRACT

In an apparatus for printing on a continuously moving sheet of work material, a frame is provided and defines a work supporting surface over which a sheet of work material is advanced in a first coordinate direction longitudinally of itself. An elongated support is mounted to the frame and extends transversely across the work supporting surface. A print head is mounted to the elongated support and is movable across the support, as well as between a forward and rearward position. During operation, as the work material is continuously advanced through the apparatus, the print head traverses the support and simultaneously moves between the forward and rearward positions, such that the print head has a component of speed in the first coordinate direction approximately equal to the rate at which the work material is advanced. This causes the print head to print successive lineal portions of a graphic oriented approximately perpendicular to the first coordinate direction while the work material is continuously advanced.

15 Claims, 3 Drawing Sheets

METHOD AND APPARATUS FOR PRINTING ON A CONTINUOUSLY MOVING SHEET OF WORK MATERIAL

CROSS REFERENCE TO RELATED APPLICATION

This application is a continuation of U.S. patent application Ser. No. 09/166,314, now U.S. Pat. No. 6,056,454, filed on Oct. 5, 1998 by inventors Plumley and Stein.

FIELD OF THE INVENTION

The present invention relates generally to printing on sheet-type work materials using inkjet, dot matrix, thermal, or like print heads, and deals more particularly with an apparatus and method for printing on a continuously fed sheet of work material.

BACKGROUND OF THE INVENTION

The present invention is directed to an apparatus and method for printing a graphic onto a continuously moving sheet of work material, and will be described herein as applied to such use.

In known printers, a single print head is usually mounted on a frame for movement transversely across a piece of sheet-type work material. In many instances the print head includes a print cartridge having an ink reservoir and a number of discrete inkjets arranged in a matrix-like pattern adjacent to the media to be printed. This matrix-like pattern of inkjets is referred to by those skilled in the pertinent art as an array.

Typically, a line of a graphic is printed onto the work material by causing the print head to traverse the work material while the work material is stationary. As the print head moves, the inkjets spray appropriately colored ink onto the work material in accordance with commands issued from a controller. The work material is then incrementally advanced an amount preferably equal to the height of the array of inkjets, and the print head makes another pass across the work material. This process of incrementally advancing the work material and printing, is continued until the entire graphic is printed thereon.

A problem associated with printing in the above-described manner is that the incremental indexing of the work material causes the printing process to be very time consuming, and therefore expensive. In addition, in large printing applications, it is often necessary to accelerate and decelerate large rolls of sheet material whose inertia can make accurate indexing difficult.

Moreover, the discrete motion of the work material can cause slight misalignments therein, that in turn generate inaccuracies in the printed graphic. In addition, after a line is printed the work material must be advanced an amount equivalent to the height of the array of inkjets defined by the print cartridge. Any deviation will either cause overlap or gaps between successive printed lines depending on whether the work material is advanced too far or too little.

Based on the foregoing, it is the general object of the present invention to provide a printing apparatus that overcomes the above-described problems and drawbacks present in the prior art.

It is a more specific object of the present invention to provide a printing apparatus that can print a graphic onto a piece of sheet-type work material while the material is continuously advanced through the printing apparatus.

SUMMARY OF THE INVENTION

The present invention is directed to an apparatus for printing on a continuously moving sheet of work material that includes a frame defining a work supporting surface, as well as means for continuously feeding the work material in a first coordinate direction longitudinal of itself, over the work supporting surface. An elongated support having first and second ends is coupled to the frame and extends transversely across the work supporting surface with at least one print head coupled to the support for movement between the first and second ends.

In an embodiment of the present invention, means are provided for selectively and continuously moving the print head across the elongated support between the first and second ends. A controller having graphical data stored therein in machine readable format is in communication with the printing apparatus and the print head. During operation, and in response to commands issued from the controller, the combined motion of the print head and the work material relative to one another, causes successive lineal portions of the graphic to be transferred onto the work material and be oriented approximately perpendicular to the first coordinate direction.

Preferably, the print head includes a plurality of spaced-apart rows of discrete print elements, such as ink jets arranged in a matrix-like array having a given height. During operation, when the print head reaches either the first or second end of the elongated support, the above-described means for progressively moving the print head cause it to move in a direction opposite to the first coordinate direction, an amount equal to the width of the printed line less the distance moved by the work material during this print head motion.

In another embodiment of the present invention, a portion of the array of print elements is selectively actuated, allowing the actuated portions of the array to shift along the first coordinate direction as the print head traverses the advancing sheet material. Accordingly, the shifting portions of the array of print elements in combination with the motion of the material in the first coordinate direction cause the print head to print a lineal portion of a graphic onto the work material.

The means for selectively and continuously moving the print head between the first and second ends of the elongated support, can take the form of a belt mounted on a pair of sprockets that in turn are rotatably mounted to the support. One sprocket in the pair is located adjacent to the first end of the support, and the other sprocket in the pair is located adjacent to the second end of the support.

Alternatively, the belt can be mounted at an angle relative to the work material, thereby eliminating the need for the print to move between the above-described retracted and extended positions.

In another embodiment of the present invention, the elongated support is pivotally coupled to the frame for selective movement between first and second angles. Preferably, the second angle is approximately equal and opposite to the first angle. In operation, the print head is slidably coupled to, and moves along the support between the first and second ends. The support pivots between the first and second angles in response to commands issued from the controller, enabling the print head to continuously print successive lineal portions of a graphic onto the work material and oriented approximately perpendicular to the first coordinate direction.

In still another embodiment of the present invention, the path traversed by the print head is figure-8-shaped and is defined by a path coupled to an underside of the elongated support. The path includes a first segment oriented along a first angle and a second segment oriented along a second angle approximately equal and opposite to the first angle. Preferably, the second segment crosses the first segment at a point approximately midway across the work material being fed through the apparatus.

In addition to the foregoing, the present invention can also employ a plurality of staggered print heads, slidably coupled to the elongated support and spaced a predetermined distance away from the next successive print head. During operation, each of the print heads prints a lineal portion of the graphic along a line approximately perpendicular to the first coordinate direction as the print head traverses a respective one of the first and second segments, thereby printing several lines in a single pass.

The present invention also resides in a method for printing a graphic onto a continuously moving sheet of work material whereby an apparatus as described above is provided. The work material is moved through the apparatus in the first coordinate direction, at a predetermined rate. The print head, in response to commands issued from the controller traverses the elongated support between the first and second ends. Concomitant with this movement, the print head is also moved between the forward and rearward positions, such that the movement of the print head has a component of speed in the first coordinate direction approximately equal to the rate at which the work material is being advanced. While the print head is being moved, a lineal portion of a graphic is printed onto the work material and is oriented approximately perpendicular to the first coordinate direction.

Upon reaching either of the first or second ends, the print head is moved in a direction opposite to the first coordinate direction an amount approximately equal to the width of the printed line, less the distance the work material was advanced during the print head's motion the print is then moved back across the work material.

DETAILED DESCRIPTION OF THE PREFERRED EMBODIMENTS

Figure 1:
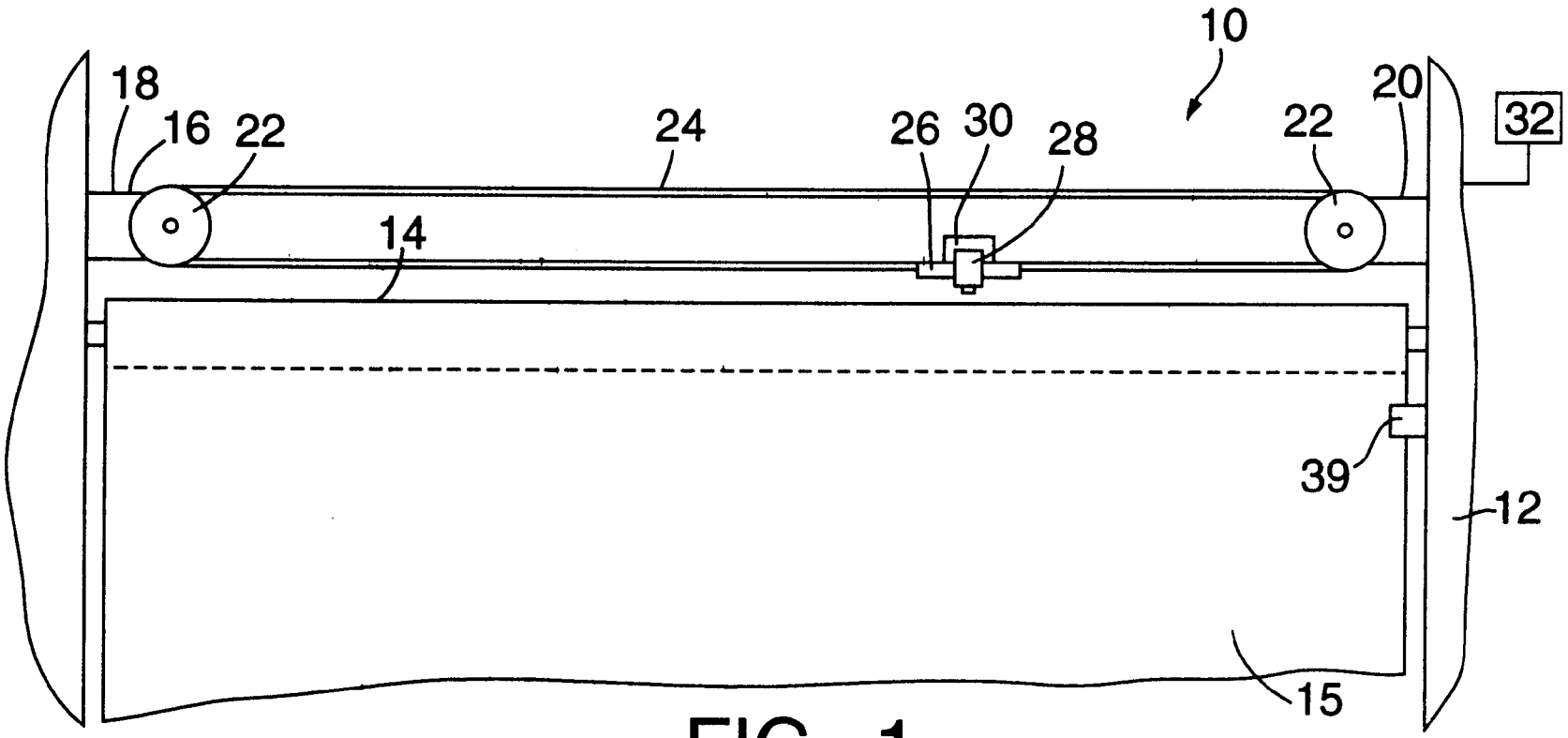
FIG. 1 is a schematic illustration of the apparatus of the present invention.

As shown in FIG. 1 a plotter embodying the apparatus of the present invention is generally designated by the reference numeral 10, and includes a frame 12 that defines a work supporting surface 14, shown in the illustrated embodiment as a roller mounted for rotation to the frame. A sheet of work material 15 overlies the work supporting surface 14 and is continuously advanced in a first coordinate direction longitudinally of itself by suitable means (not shown), such as but not limited to a friction or sprocket drive. An elongated support 16 extends transversely across the work supporting surface 14 and is attached to the frame 12. A pair of sprockets 22 are rotatably mounted to the frame 12 and a belt 24 is mounted on the sprockets. At least one of the sprockets is driven by a suitable drive, such as, but not limited to a servo or stepper motor (not shown). A bracket 26 is attached to the belt 24 adjacent to the work supporting surface 14 with a print head 28, explained in detail hereinafter, slidably mounted on the bracket 26.

An actuator 30, such as a stepper motor, or servo is also mounted to the bracket 26 and engages the print head 28. A controller 32, having data corresponding to a graphic to be printed onto the work material 15 stored therein in machine readable format is in communication with the apparatus 10 for issuing commands thereto during operation. While the actuator 30 has been described as being a stepper motor, or a servo, the present invention is not limited in this regard as other actuators known to those skilled in the pertinent art may be substituted. For example, a mechanical cam, a hydraulic or pneumatic cylinder coupled to a servo valve could be employed without departing from the broader aspects of the present invention.

Figure 2:
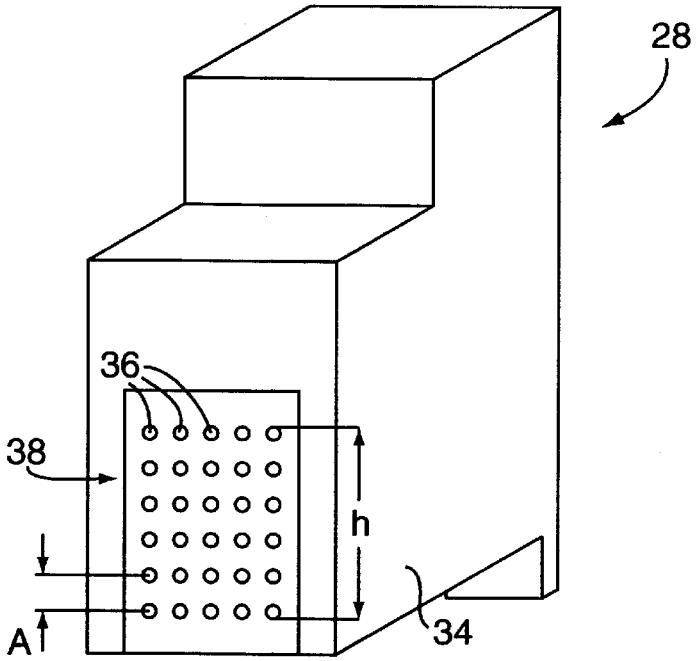
FIG. 2 is a perspective view of the print head showing a plurality of discrete ink jets arranged in an array.

As shown in FIG. 2, a print head 28 useful with the present invention includes an ink reservoir 34 and a plurality of rows of discrete printing elements shown in the illustrated embodiment as ink jets 36 spaced apart by a distance "A" and arranged in a matrix-like array 38 defining a height designated in FIG. 2 by "h". The ink jets 36 are in fluid communication with the reservoir 34 and can be selectively actuated in response to commands issued from the controller, to print onto the work material 15, FIG. 1. While the array illustrated in FIG. 2 is rectangular, the present invention is not limited in this regard as other geometric array configuration, such as staggered arrays, can be substituted without departing from the broader aspects of the present invention. The print head 28 may be a dot matrix print head.

During operation, the work material 15 is continuously advanced through the apparatus 10 longitudinal of itself in the first coordinate direction. The belt 24 is driven by the sprockets 22 in response to commands issued from the controller 32, thereby causing the print head to traverse the work material 15 between the first and second ends, 18 and 20 respectively, of the elongated support 16. Simultaneously, the actuator 30 moves the print head 20 between a forward and rearward position such that the motion of the print head has a component of speed in the first coordinate direction approximately equal to the rate at which the work material 15 is advanced through the apparatus 10. As the print head 28 traverses the work material 15, it prints a lineal portion of a graphic onto the work material in response to commands issued from the controller 32. The combined motion of the print head 28 and the work material 15, causes the print head to follow and print a line approximately perpendicular to the first coordinate direction.

When the print head 28 reaches the first or second end, 18 or 20 respectively, of the support 16, the actuator 30, in response to commands issued from the controller 32 causes the print head to move from the forward to the rearward position or vice versa in a direction opposite to the first coordinate direction by an amount approximately equal to the width of the line just printed. Accordingly, the distance moved by the print head is equal to the width of the line just printed, less the distance moved by the work material while the print head is moving. In this manner the print head 28 can print successive lineal portions of the graphic without any undesired gaps between them while the work material is continuously advanced.

In another embodiment of the present invention, portions of the array 38 of print elements 36 can be sequentially activated as the print head 28 traverses the work material. In this manner, the sequential activation of the print elements 36 can be such as to mimic the above-described movement of the print head 28 between the rearward and forward positions, thereby printing lineal portions of a graphic without any undesirable gaps.

The present invention can also include a feed back sensor 39 mounted to the apparatus 10 for sensing the speed at which the work material is being advanced. During operation, the feedback sensor 39 generates and sends signals to the controller corresponding to the speed at which the work material is being advanced. The speed at which the print head 28 prints, or traverses the elongated support and thereby the work material is then adjusted, in response to commands issued from the controller, to compensate for any variations in the speed at which the work material is being advanced. In addition, the rate at which the work material is advanced can also be adjusted to compensate for any delays in communications between the controller and the print head.

Figure 3:
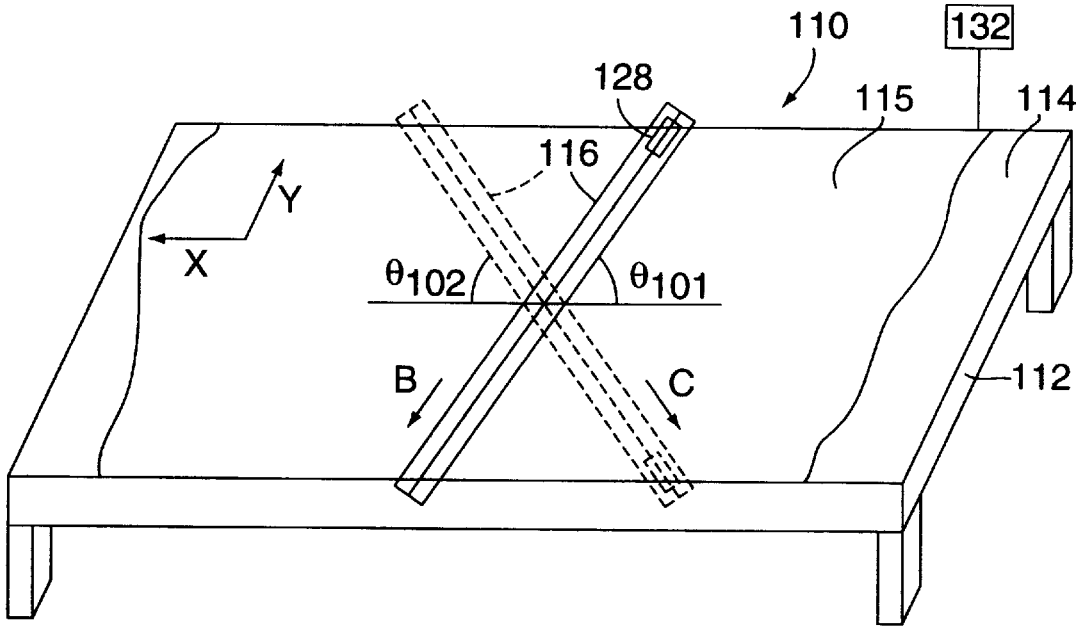
FIG. 3 is a perspective view of an embodiment of the apparatus of FIG. 1 showing a support pivotally coupled to the frame for guiding the print head.

An embodiment of the apparatus of the present invention, shown in FIG. 3, is generally designated by the reference numeral 110. The apparatus 110 is similar in many respects to the apparatus 10 described above, and therefore like reference numerals preceded by the number 1 are used to indicate like elements. In this embodiment, the elongated support 116 is pivotally mounted to the frame 112 for movement between a first angle $\theta_{101}$ measured relative to the first coordinate direction designated as X in FIG. 3, and a second angle $\theta_{102}$ (shown in phantom) approximately equal and opposite in magnitude to the first angle. The support 116 is moved in response to commands issued from the controller by suitable means (not shown), such as, but not limited to a stepper motor, or servo.

The print head 128 is slidably and pivotally mounted on the support for movement in a first direction indicated by the arrow B when the support 118 is oriented along the first angle $\theta_{101}$, and in a second direction generally indicated by C when the support (shown in phantom) is oriented along the second angle $\theta_{102}$. While the path has been shown and described as being figure-8-shaped, the present invention is not limited in this regard as other path shapes, such as, but not limited to oval, can be substituted without departing from the broader aspects of the present invention. In addition, while a flat-bed type plotter is illustrated, the present invention is not limited in this regard as other plotter configurations such as that shown in FIG. 1 can be employed without departing from the broader aspects of the present invention.

During operation, as the work material is continuously advanced in the first coordinate direction X, the support 118 is pivoted into position along the angle $\theta_{102}$ in response to commands issued by the controller. The print head 128 moves transversely across the work material 115 in the first direction B. Commands issued from the controller 132 regulate the speed of the print head 128, such that the component of the speed of the print head in the first coordinate direction X approximately equals the speed at which the work material 115 is advanced over the work supporting surface 114. The motion of the print head relative to the advancing work material causes the print head 128 to print a lineal portion of the graphic along a first line approximately perpendicular to the first coordinate direction.

Once the above-described lineal portion is printed, the support 116 is pivoted into position along the angle $\theta_{102}$ in response to commands issued by the controller and the print head 128 moves across the work material 115 in the second direction C. Similar to the movement of the print head 128 in the first direction, commands issued from the controller regulate the speed of the print head such that the component of the print head speed in the first coordinate direction X approximately equals the speed at which the work material 115 is advanced over the work supporting surface 114. This causes the print head 128 to print a lineal portion of the graphic along a second line approximately parallel to the first line. In addition to controlling the speed of the print head 128 as it traverses the work material 115 in the first and second directions, B and C respectively, commands issued from the controller also adjust the angles $\theta_{102}$ and $\theta_{102}$, to insure that the graphic is printed approximately perpendicular to the first coordinate direction X. In addition, the support is pivoted between $\theta_{101}$ and $\theta_{102}$ at a rate sufficient to insure that the first and second printed lines are oriented properly with respect to one another and the desired final graphic. While the apparatus 110 has been shown and described as including a single print head 128, the invention is not limited in this regard as a plurality of print heads can be coupled for movement to the support, with each print head being staggered a predetermined distance away from the next successive print head.

Figure 4:
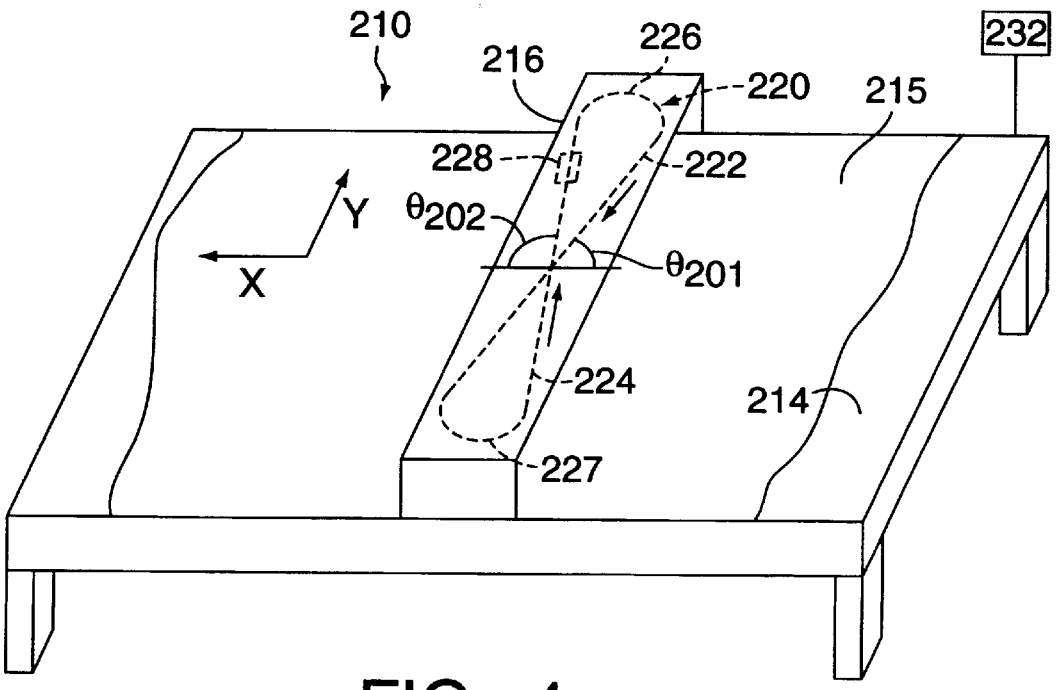
FIG. 4 is a perspective view of another embodiment of the apparatus of FIG. 1 showing a support defining a figure-8-shaped path for guiding the print head.

Another embodiment of the apparatus of the present invention, shown in FIG. 4, is generally designated by the reference numeral 210. The apparatus 210 is similar in many respects to the apparatus 10 described above, and therefore like reference numerals preceded by the number 2 are used to indicate like elements. In this embodiment, the support 216 includes a figure-8-shaped path (shown in phantom) generally designated by the reference numeral 220 mounted to an underside of the support. The figure-8-shaped path 220 includes a first segment 222 extending transversely across the work material 215 and oriented at an angle $\theta_{101}$ relative to the first coordinate direction X, and a second segment 224, also extending transversely across the work material 215 and oriented at a second angle $\theta_{202}$ relative to the first coordinate direction. The second segment 224 crosses the first segment 222 at a point approximately midway across the work material 215. As shown in FIG. 4, the first and second segments, 222 and 224 respectively, are joined at their respective end points by arcuate segments 226 and 227 to complete the figure-8. The print head 228 is coupled to and continuously traces the figure-8-shaped path 220.

During operation, as the work material 215 is advanced in the first coordinate direction X, the print head 216 traces the figure-8-shaped path 220. Similarly to the above-described embodiments of the present invention. The speed at which the print head 228 moves along the first and second segments, 222 and 224 respectively, is regulated by the controller such that the component of print head speed in the first coordinate direction X equals the speed at which the work material 215 is advanced over the work support surface 214. Accordingly, the print head 228 will print successive lineal portions of a graphic oriented approximately perpendicular to the first coordinate direction, in response to commands issued from the controller 232.

The arcuate segments 226 and 227 each extend across the support 216 a distance approximately equal to the height "h" of the array, as shown in FIG. 2. In order to avoid gaps in the printed graphic, the print head must traverse the arcuate segments 226 and 227 in the time it takes for the work material 215 to advance a distance approximately equal to the spacing "a", FIG. 2, between adjacent rows of ink jets 36 in the array 38.

Figure 5:
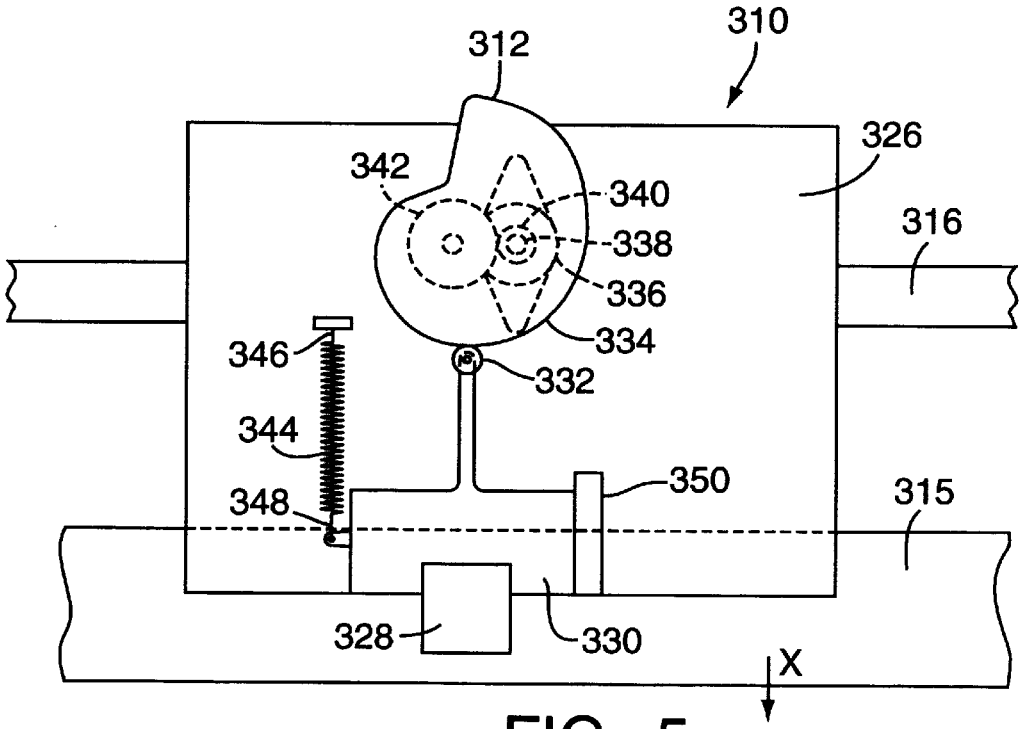
FIG. 5 is a partial view of another embodiment of the apparatus of FIG. 1 showing a cam actuated print head.

Yet another embodiment of the apparatus of the present invention is shown in FIG. 5 and is generally designated by the reference numeral 310. The apparatus 310 is similar in many respects to the apparatus 10 described above, and, therefore, like reference numerals preceded by the number 3 are used to indicate like elements. In this embodiment, the print head 328 is driven between the forward and rearward positions by a cam 312 rotatably mounted to a bracket 326. The bracket 326 is in turn mounted an elongated support 316 which moves the bracket transversely across a sheet of work material 315. The print head 328 is attached to a print head carrier 330 which is slidably mounted on the bracket 326 for movement between a forward and rearward position. The print head carrier 330 includes a cam follower 332 coupled for rotation thereto and in engagement with a periphery 334 defined by the cam. The cam is driven by a suitable means such as a stepper motor 336 (shown in dotted line) having a rotatable shaft 338 extending therefrom and a pinion 340 mounted thereto and engaging a gear 342 which drives the cam 312. A spring 344 is attached at one end 346 to bracket 326 and at an opposite end 348 to the print head carrier 330. A guide member 350 is also mounted to the bracket 326 for directing the motion of the print head carrier 330 between its forward and rearward position.

During operation, as the bracket 326 traverses the sheet material 315 which in turn is continuously moving in a direction longitudinal of itself as indicated by the arrow labeled X, the cam 312 is rotated via stepper motor 336 causing the print head 328 to move between the forward and rearward position in response to commands issued from the controller. The cam is configured, and the stepper motor rotated at such a rate as to impart a component of velocity in the direction indicated by the arrow X that is equal to the rate at which the sheet material 315 is advanced. When the print head 328 has traversed the sheet material 315, the spring 344 then acts to return the print head 328 to the rearward position thereby allowing the next line to be printed. In this manner, lineal portions of a graphic perpendicular to the direction of motion of the sheet material are consecutively printed until the desired graphic is transferred to the sheet material.

While preferred embodiments have been shown and described, various modifications and substitutions may be made without departing from the spirit and scope of the present invention. Accordingly, it is to be understood that the present invention has been described by way of example, and not by limitation.

What is claimed is:

1. An apparatus for printing on a continuously moving sheet of work material, comprising:

a frame;

a work supporting surface carried by said frame;

means for continuously advancing a sheet of work material in a first coordinate direction longitudinally of itself, over said work supporting surface;

an elongated support, coupled to, and extending transversely across, said frame, said support having opposed first and second ends;

at least one print head movably coupled to said support adjacent to said work supporting surface;

drive mechanism for selectively and continuously moving said print head across said support between said first and second ends;

a controller having data corresponding to a graphic stored therein, such that during operation, the positional relationship of said print head relative to said support and said work material is such that the combined motion of said print head and said work material causes said print head to print successive lineal portions of said graphic in response to commands issued from said controller, said lineal portions being oriented approximately perpendicular to said first coordinate direction.

2. An apparatus for printing on a continuously moving sheet of work material as defined by claim 1, further comprising:

said print head including a plurality of discrete print elements arranged in a matrix-like array, said array defining a height; and means for progressively moving said print head between a retracted and an extended position, so that during operation said print head, upon reaching each of said first and second ends of said support moves an amount approximately equal to said array height, less the distance advanced by said work material during said movement in a direction approximately opposite to said first coordinate direction.

3. An apparatus for printing on a continuously moving sheet of work material as defined by claim 1, wherein said means for selectively and continuously moving said print head across said elongated support includes:

a pair of sprockets one of which is rotatably coupled to said support at each of said first and second ends;

a belt mounted for rotation on said pair of sprockets;

driving means for rotating at least one of said sprockets and thereby said belt, in response to commands issued from said controller; and wherein said print head is coupled to said belt, thereby causing said print head to move along said support upon rotation of said sprockets.

4. An apparatus for printing on a continuously moving sheet of work material as defined by claim 2, wherein said means for progressively moving said print head between a retracted and an extended position includes:

a mounting bracket coupled to said support;

said print head being slidably coupled to said mounting bracket; and an actuator coupled to said mounting bracket adjacent said print head for moving said print head between said retarcted and extended positions in response to commands issued from said controller.

5. An apparatus for printing on a continuously moving sheet of work material as defined by claim 4, wherein said actuator is a stepper motor.

6. An apparatus for printing on a continuously moving sheet of work material as defined by claim 4, wherein said actuator is a servo.

7. An apparatus for printing on a continuously moving sheet of work material as defined by claim 4, wherein said actuator includes a pneumatic cylinder and a servo controlled valve for actuating said cylinder.

8. An apparatus for printing on a continuously moving sheet of work material as defined by claim 4, wherein said actuator includes a mechanical cam.

9. An apparatus for printing on a continuously moving sheet of work material as defined by claim 1, wherein:

said support is pivotally coupled to said frame for movement between a first and second angle; and said print head is slidably coupled to said support adjacent to said support surface for movement transversely across said work material from said first to said second end when said support is oriented along said first angle, and from said second to said first end when said support is oriented along said second angle.

10. An apparatus for printing on a continuously moving sheet of work material as defined by claim 1, wherein:

said elongated support includes an approximately figure-8-shaped path coupled to the support and having a first segment extending transversely across said work material and oriented at an angle, and a second segment extending transversely across said work material and oriented at a second angle, said second angle being approximately equal and opposite to said angle of said first segment, said second segment crossing said first segment at a point approximately midway across said work material; and said print head is slidably coupled to said path and continuously traces said figure-8-shaped path as said sheet material is continuously advanced in said first coordinate direction.

11. An apparatus for printing on a continuously moving sheet of work material as defined by claim 1 wherein said at least one print head is an inkjet print head.

12. An apparatus for printing on a continuously moving sheet of work material as defined by claim 1 wherein said at least one print head is a dot matrix print head.

13. An apparatus for printing on a continuously moving sheet of work material as defined by claim 1, wherein the work supporting surface is substantially flat.

14. An apparatus for printing on a continuously moving sheet of work material as defined by claim 1, wherein the work supporting surface is a roller.

15. A method for printing on a continuously moving sheet of work material, comprising the steps of:

(a) providing a printing apparatus having a frame defining a work supporting surface, means for continuously moving a sheet of work material at a known rate in a first coordinate direction longitudinal of itself, over said work supporting surface, an elongated support, said frame coupled to, and extending transversely across, at least one print head movably coupled to said elongated support and defining a plurality of discrete print elements arranged in a matrix-like array defining an array height, means for moving said print head across said elongated support between said first and second ends, and a controller for issuing commands to said apparatus corresponding to a graphic to be printed;

(b) providing a sheet-type work material;

(c) continuously advancing said work material through said apparatus in said first coordinate direction;

(d) moving said print head across said elongated support such that the movement of the print head has a component of velocity in the first coordinate direction approximately equal to the rate at which the work material is advanced through the apparatus;

(e) printing a first lineal portion of said graphic onto said work material along a line approximately perpendicular to said first coordinate direction in response to commands issued from said controller;

(f) moving said print head, upon completion of said first lineal portion in a direction approximately opposite to said first coordinate direction, a distance equal to the array height less a distance advanced by said work material during the time in which said print head is moving opposite said first coordinate direction;

(g) repeating steps (d)–(f) until said graphic is printed on said work material.

* * * * *

UNITED STATES PATENT AND TRADEMARK OFFICE

CERTIFICATE OF CORRECTION

PATENT NO. : 6,431,773 B1 
DATED : August 13, 2002
INVENTOR(S) : A. Bruce Plumley and Darryl Colburn Stein It is certified that error appears in the above-identified patent and that said Letters Patent is hereby corrected as shown below:

Column 8,
Line 45, "retarcted" should read -- retracted --

Signed and Sealed this

Eleventh Day of February, 2003

JAMES E. ROGAN
*Director of the United States Patent and Trademark Office*